US007472675B2

(12) United States Patent
Reustle

(10) Patent No.: US 7,472,675 B2
(45) Date of Patent: Jan. 6, 2009

(54) INTERNAL COMBUSTION ENGINE

(75) Inventor: Albrecht Reustle, Walheim (DE)

(73) Assignee: Dr. Ing. h.c.F. Porsche Aktiengesellschaft, Stuttgart (DE)

( * ) Notice: Subject to any disclaimer, the term of this patent is extended or adjusted under 35 U.S.C. 154(b) by 0 days.

(21) Appl. No.: 11/826,794

(22) Filed: Jul. 18, 2007

(65) Prior Publication Data

US 2008/0022964 A1 Jan. 31, 2008

(30) Foreign Application Priority Data

Jul. 31, 2006 (DE) ..... 10 2006 035 888

(51) Int. Cl.
*F01M 11/00* (2006.01)

(52) U.S. Cl. ..... 123/196 R; 123/195 C; 123/198 E

(58) Field of Classification Search ..... 123/196 R, 123/196 CP, 195 C, 198 E
See application file for complete search history.

(56) References Cited

U.S. PATENT DOCUMENTS

| | | | | |
|---|---|---|---|---|
| 5,136,993 | A | 8/1992 | Ampferer et al. | |
| 5,572,968 | A | 11/1996 | Esch et al. | |
| 6,578,541 | B2 | 6/2003 | Stromsky et al. | |
| 6,729,292 | B1 * | 5/2004 | Bock et al. | 123/195 C |
| 7,055,509 | B2 * | 6/2006 | Hara | 123/572 |
| 7,201,132 | B2 * | 4/2007 | Miyake et al. | 123/196 W |
| 7,334,556 | B2 * | 2/2008 | Wachigai et al. | 123/195 HC |

FOREIGN PATENT DOCUMENTS

| | | | |
|---|---|---|---|
| DE | 40 01 468 | A1 | 7/1991 |
| DE | 44 24 248 | C1 | 12/1995 |
| DE | 100 29 844 | B4 | 4/2004 |
| JP | 2005-171777 | * | 6/2005 |

* cited by examiner

*Primary Examiner*—Hai H Huynh
(74) *Attorney, Agent, or Firm*—Crowell & Moring LLP

(57) ABSTRACT

An internal combustion engine includes a crankcase in which a crankshaft is rotatably mounted. Mechanisms are provided for scraping off the oil from the rotating crankshaft. An oil pan is arranged below the crankcase for holding the oil scraped off by the scrapers.

9 Claims, 4 Drawing Sheets

INTERNAL COMBUSTION ENGINE

RELATED APPLICATIONS

This application claims the benefit of priority under 35 U.S.C. § 119 to German patent application no. 10 2006 035 888.0, filed Jul. 31, 2006, the disclosure of which is incorporated by reference herein.

BACKGROUND AND SUMMARY OF THE INVENTION

The present invention relates to an internal combustion engine with a crankcase, in which a crankshaft is mounted in a rotatable manner.

An internal combustion engine is disclosed in DE 44 24 248 C1. The oil is pumped over pressurized channels, running inside the walls of the cylinder head, and the adjoining longitudinal channels to air/oil separating elements inside the crankcase, in order to separate the air from the oil, flowing back into the oil pan. This separation of the air from the oil maintains the quality of the oil and guarantees that the internal combustion engine will operate reliably. However, the drawback with this feature is high casting complexity in producing the relatively long channels, the high space requirement, and the high power output required to circulate the oil and to separate the air from the oil.

DE 40 01 468 A1 describes an oil guide housing for an internal combustion engine, in which there are oil lathes, constructed as ribs, with which the oil is planed off from the figure eight-shaped connecting rod and is returned over the return channels into the oil pan. Yet this prior art design does not make it possible to separate the air from the oil returned to the oil pan.

Therefore, an object of the present invention is to provide an internal combustion engine, in which the oil is returned to the oil pan as fast as possible and with minimal air content. The necessary scrapers and air/oil separators to fulfill this requirement require as little space as possible and ought to exhibit a compact configuration.

The present invention solves this problem the oil scrapers are designed as one piece with at least one air/oil separator and are guided to the oil inlet opening of the air/oil separator, at least one oil outlet opening being assigned to at least one air/oil separator in such a manner that in each driving state of a motor vehicle, provided with the internal combustion engine said oil outlet opening is located above an oil level in the oil pan.

The result of the present invention's integral configuration of at least one air/oil separator with the oil scrapers is a very compact type of construction of these two parts, so that they may be integrated into the internal combustion engine without any problems. In addition, the negligible spacing between the air/oil separator and the oil scrapers eliminates the need for a pump, since the oil is scraped off due to the high kinetic energies prevailing in the air/oil separator. Furthermore, to the density difference between air and oil allows the oil to be separated automatically, such an automatic oil separation being the goal. Another advantage of the present invention lies in the feature that no additional channels or the like have to be integrated into the crankcase, thus eliminating any additional casting complexity.

In each driving state of the motor vehicle provided with the internal combustion engine of the invention, at least one oil outlet opening of the air/oil separator is located above the oil level in the oil pan. Thus, the oil is always guaranteed to return to the oil pan without any constraints and without resistance.

Preferably all of the oil outlet openings are arranged above the oil level occurring in the oil pan.

If in an advantageous further embodiment of the invention the longitudinal axis of the air/oil separator, around which the oil that is introduced rotates, runs substantially parallel to the crankshaft, then additional space problems are eliminated, because the air/oil separator is usually much larger in the direction of its longitudinal axis than in a plane perpendicular thereto. That is, the air/oil separator is installed in a reclining manner. Yet this feature does not have a negative impact on its function, because the oil does not flow into said air/oil separator due to gravity, but rather due to high centrifugal force.

An especially large amount of oil may be scraped from the crankshaft rotating in the crankcase if each oil scraper is assigned to a connecting rod and each oil scraper has two oil scraping openings arranged one after the other in succession in the crankshaft rotation direction.

Furthermore, a tapering channel may be provided to run from each oil scraping opening to the air/oil separator. Such a tapering channel can increase the oil flow, rate and the oil may thus be guided even faster to the air/oil separator.

Other objects, advantages and novel features of the present invention will become apparent from the following detailed description of the invention when considered in conjunction with the accompanying drawings.

DETAILED DESCRIPTION OF THE INVENTION

Figure 1:
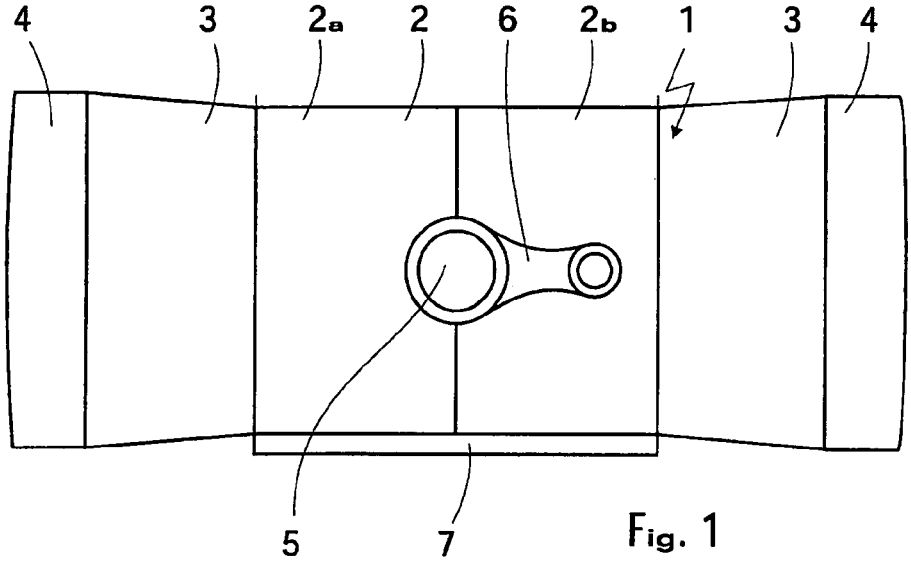
FIG. 1 is a schematic elevational view drawing of an internal combustion engine.

FIG. 1 depicts an internal combustion engine 1 with a crankcase 2, cylinder heads 3 mounted on the crankcase 2; and cylinder head covers 4 closing the cylinder heads 3 in a conventional manner. In this case the internal combustion engine 1 is a Boxer configuration, but it could also be configured according to any other known construction.

In the present invention, the crankcase 2 has two crankcase halves 2*a*, 2*b*, between which is mounted a crankshaft 5 with a plurality of attached connecting rods 6. The crankshaft performs a known rotational motion. For the sake of simplicity, only one of the connecting rods 6 is shown. However, the number of connecting rods matches the number of cylinders (not illustrated) of the internal combustion engine 1 and can, therefore, vary almost arbitrarily. Below the crankcase 2 there is an oil pan 7 which holds the oil that is used to lubricate the internal combustion engine 1. Therefore, the internal combustion engine 1 has a wet sump lubrication system.

Figure 2:
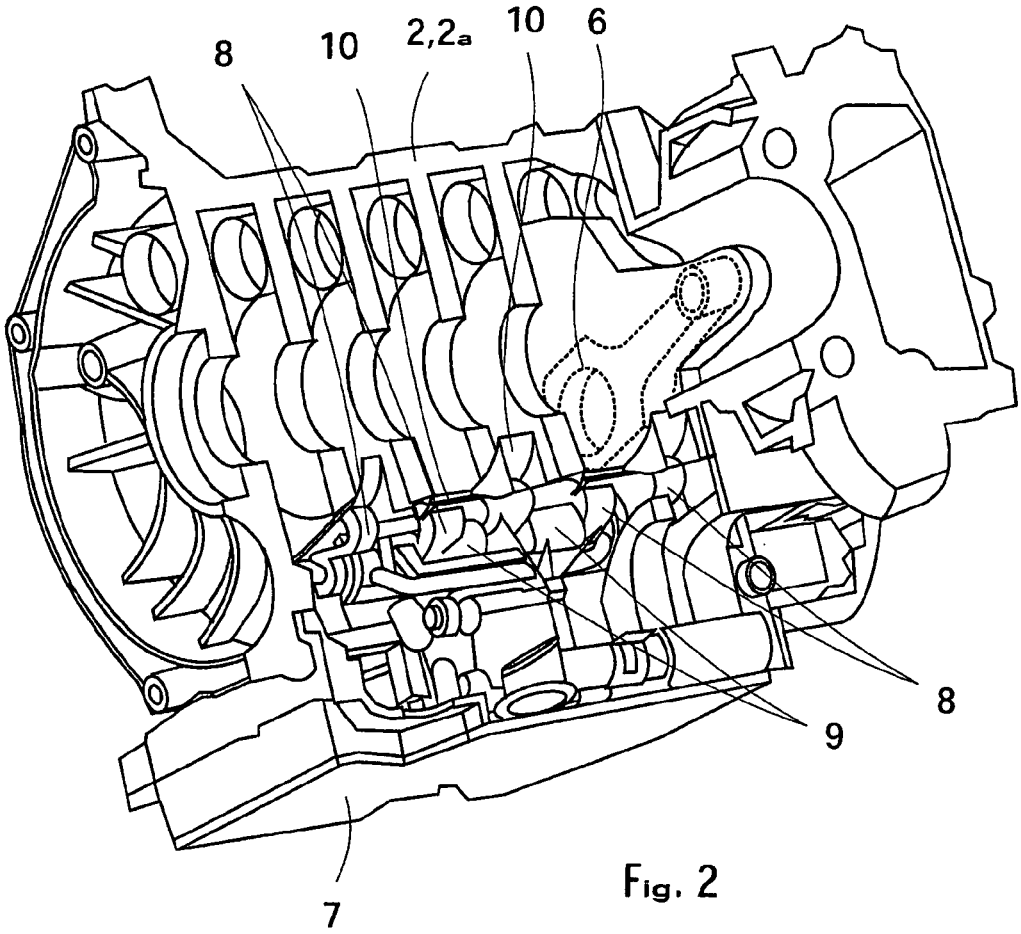
FIG. 2 is a perspective view of the crankcase of the present invention's combustion engine shown in FIG. 1.

As evident from the perspective view of FIG. 2, the internal combustion engine 1 also has a plurality of oil scrapers 8 that are used to scrape the oil from the rotating crankshaft 5 and/or from the connecting rods 6 attached to and rotate with said crankshaft, thus preventing the oil from being sprayed freely around the environment and/or from rotating, like an oil roller, along with the crankshaft 5 and the connecting rods 6. Therefore, each oil scraper 8 is associated with a connecting rod 6 because the connecting rods 6 carry with them a sizable amount of oil. Hence, an internal combustion engine 1 with only one cylinder and consequently one connecting rod 6 would be provided with only one oil scraper 8. If desired, one could also dispense with the attachment of an oil scraper 8 to individual connecting rods 6.

The oil scrapers 8 are configured as one piece with a plurality of air/oil separators 9, also called swirl pots, into which the oil, that is scraped and/or planed off of the crankshaft 5 and the connecting rods 6 is introduced and defoamed. The oil scrapers 8 and the air/oil separators 9 are shown in detail in FIG. 3. The oil scrapers 8 are assigned additional cover elements 10 made preferably of sheet metal and to prevent the oil from flowing back from the oil pan 7 into the crankcase 2. Moreover, the cover elements 10 serve to mount the oil scrapers 8 on the crankcase 2. Other oil scrapers assigned to the crank webs of the crankshaft 5 are provided between the oil scrapers 8 associated with the connecting rods 6, in order to assure that the oil is scraped off even better.

Figure 4:
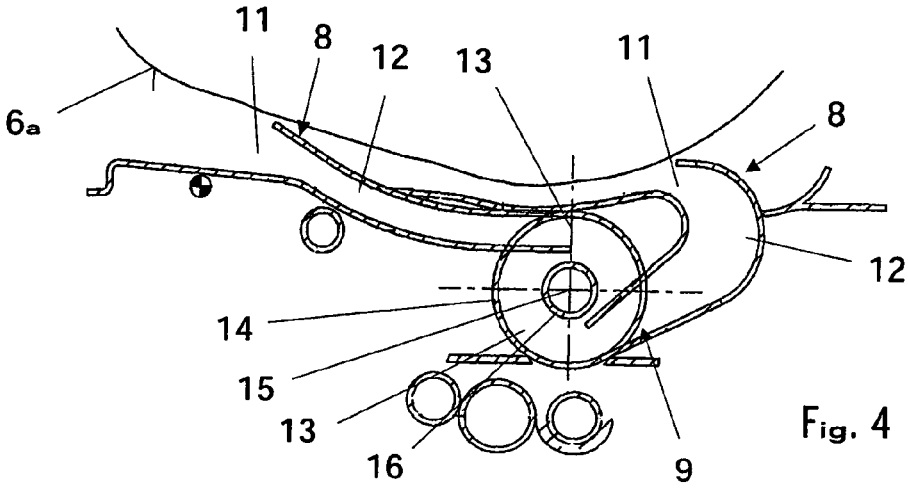
FIG. 4 is a sectional view along line IV-IV of FIG. 3.

FIG. 4 shows that each oil scraper 8 has two oil scraping openings 11 that are arranged one after the other in succession in the rotation direction of the crankshaft 5 and are adapted, upon movement of the connecting rod 6, to the envelope curve 6*a* of the connecting rod 6. A tapering channel 12 runs from the two oil scraping openings 11 to the air/oil separator 9 assigned to each oil scraper 8 in the illustrated embodiment and enters at the respective oil inlet opening 13 into the respective air/oil separator 9. In the present embodiment, the air/oil separators 9 have an essentially cylindrical housing 14 whose longitudinal axis 15 runs substantially parallel to the crankshaft 5.

Figure 7:
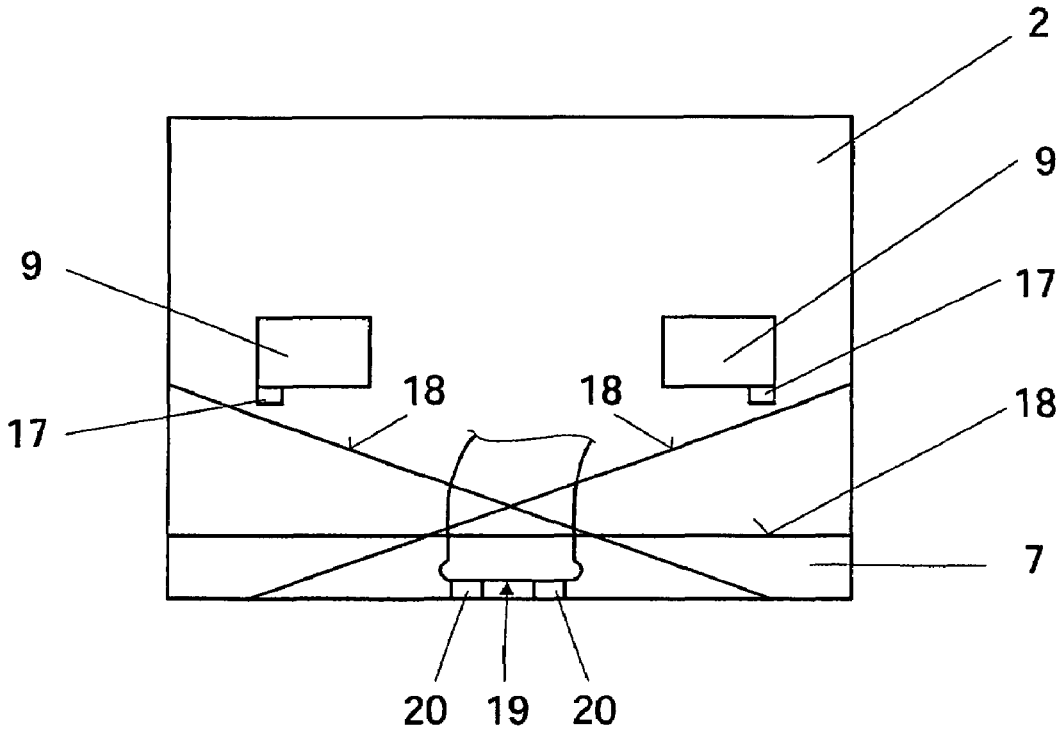
FIG. 7 is a schematic view of the crankcase of the internal combustion engine of the present invention shown in from FIG. 1.

FIG. 4 also shows that the air/oil separator 9 has an essentially central air exhaust line 16 arranged on the longitudinal axis 15 of the air/oil separator 9. The air that is separated from the oil may leave the housing 14 through the air exhaust line 16. Depending on the diameter and the length of the housing 14 and depending on the volumetric rate of flow of the oil that is expected, the air exhaust line 16 may extend more or less deeply into the housing 14 of the air/oil separator 9. Due to the centrifugal force on the inside wall of the housing 14, the oil entering into the housing 14 of the air/oil separator 9 moves along a helical path in the direction of an oil outlet opening 17 that is located opposite the air exhaust line 16 as depicted schematically in FIG. 7. The oil movement in the direction of the oil outlet opening 17 can be facilitated by a configuration of the channels 12 that slope in the direction of said oil outlet opening. The lower density of air causes the air to leave the circulating oil current inwardly and, for this reason, through the air exhaust line 16. In contrast, the oil can leave each air/oil separator 9 at the oil outlet opening 17. Thus, the oil outlet opening 17 is configured, as shown in FIG. 7, so that in each driving state of a motor vehicle provided with the internal combustion engine 1, the oil outlet opening is located above an oil level 18 (as indicated in FIG. 7) in the oil pan 7. If desired, another line could also be run from the outlet openings 17 of the individual air/oil separators 9 to a common oil outlet opening, which ought also to be located above the oil level 18 in the oil pan 7 in each driving state of the motor vehicle that is equipped with the internal combustion engine 1. Depending on the position of the vehicle, i.e., horizontal, uphill, downhill, or diagonally on the side, the result is reflected in the oil level 18, shown in FIG. 7, in the oil pan 7.

Moreover, FIG. 7 shows an intake port 19 spaced apart from the floor of the oil pan 7 by at least one spacer 20. An oil pump (not illustrated) takes in the lubricating oil from the oil pan 7 by way of the intake port 19 and conveys the oil to the lubrication sites inside the internal combustion engine 1. In each driving state of the motor vehicle or rather in each position of the vehicle, the intake port 19 ought to be located below the oil level 18, reflecting that vehicle position.

Figure 3:
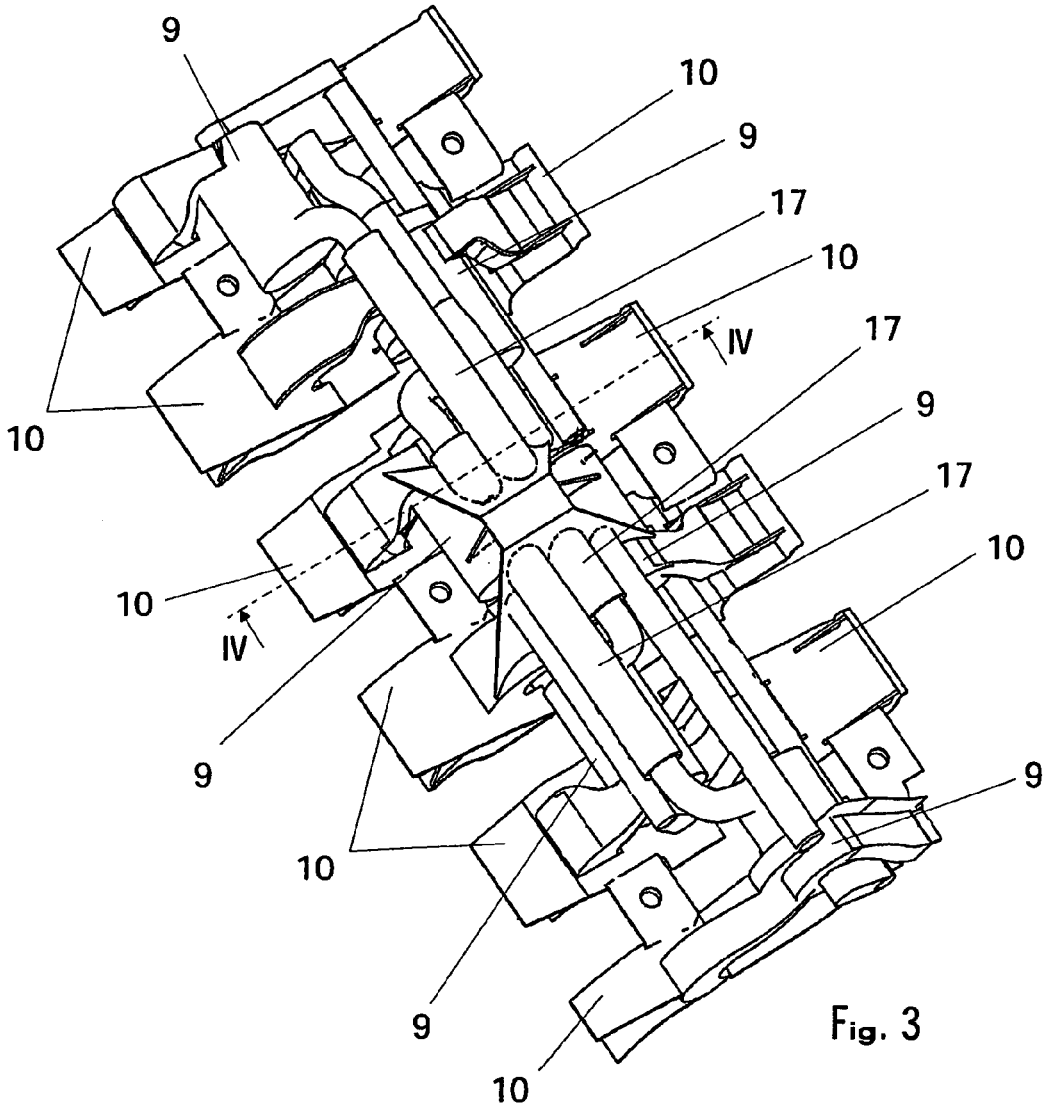
FIG. 3 is a first embodiment of the oil scrapers of the present invention with the air/oil separators.
Figure 5:
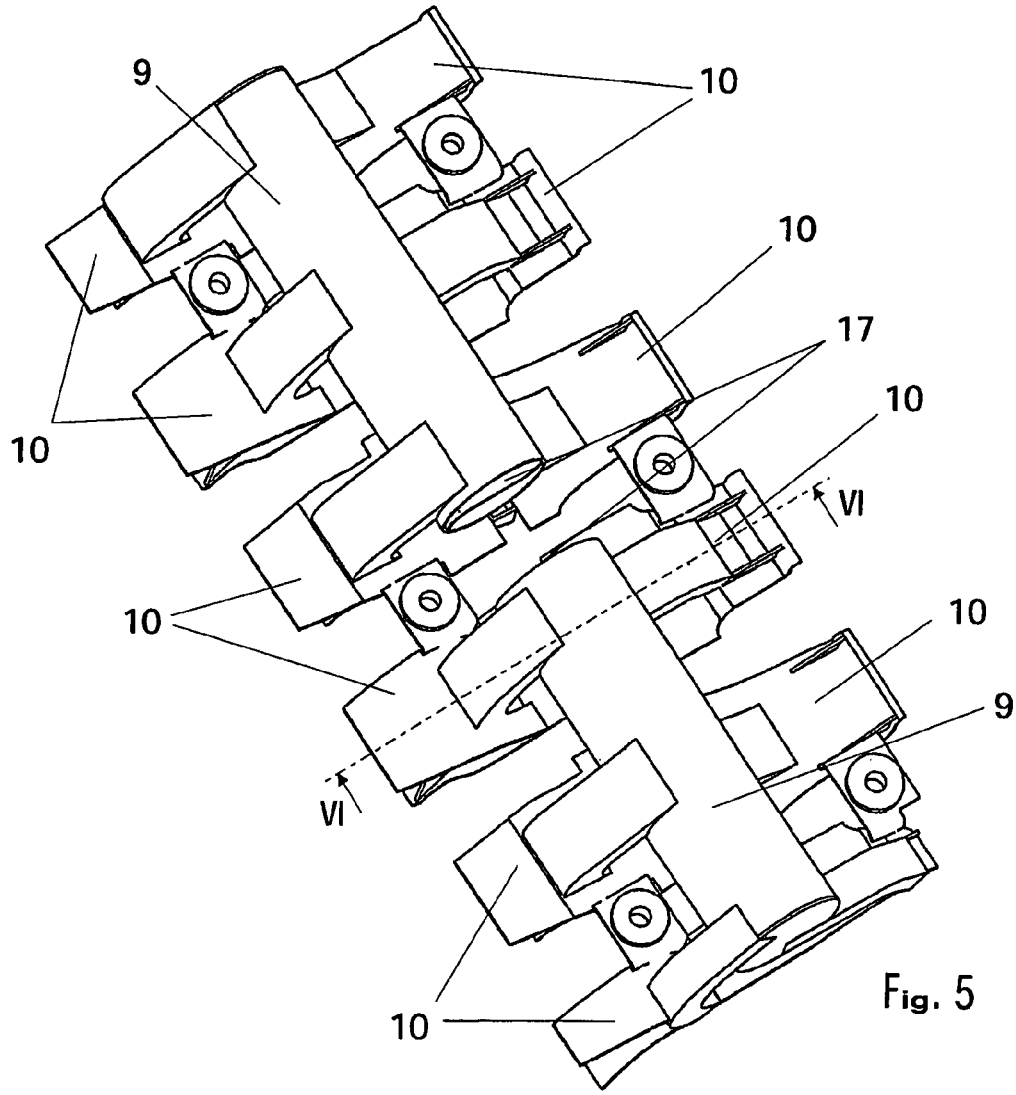
FIG. 5 is a second embodiment of the oil scrapers of the present invention with the air/oil separators.
Figure 6:
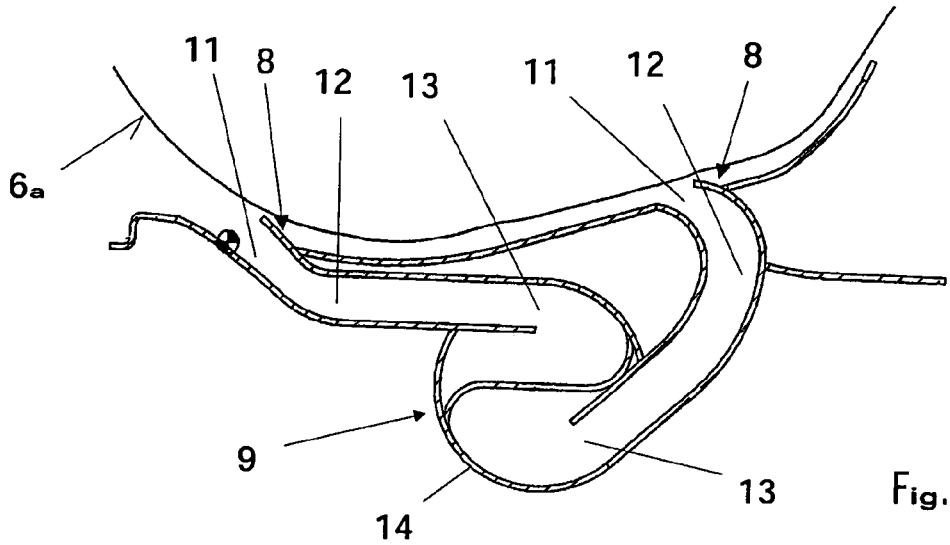
FIG. 6 is a sectional view along the line VI-VI of FIG. 5.

FIGS. 5 and 6 depict an alternative embodiment of the air/oil separators 9. Here, a plurality of oil scrapers 8 are assigned a common air/oil separator 9 that also have a cylindrical housing 14 whose longitudinal axis runs substantially parallel to the crankshaft 5. Two air/oil separators 9 are assigned three connecting rods 6. Because of the higher volume of oil to be expected, the volume of the air/oil separators 9 is larger than that of the embodiment of FIGS. 3 and 4, but the configuration in FIGS. 5 and 6 enables simpler manufacturing. In contrast, however, the embodiment of FIGS. 3 and 4 is more effective because of the smaller volume of the air/oil separators 9.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

I claim:

1. Internal combustion engine having a crankcase in which a crankshaft with at least one rotatably mounted connecting rod operatively attached thereto, comprising at least one oil scraper associated with the at least one connecting rod for scraping off oil from the crankshaft, an oil pan arranged below the crankcase for holding the oil scraped off by the at least one oil scraper, and at least one air/oil separator for separating air from returned oil, wherein the at least one oil scraper and the at least one air/oil separator are unitary and are guided to an oil inlet opening of the associated air/oil separator and at least one oil outlet opening is assigned to the at least one air/oil separator so that, in each driving state of a motor vehicle provided with the internal combustion engine, the oil outlet opening is located above an oil level in the oil pan, and the at least one oil scraper is associated with the at least one connecting rod and has two oil scraping openings arranged one after the other in succession in a crankshaft rotation direction to define an oil guiding path to the at least one air/oil separator.

2. Internal combustion engine as claimed in claim 1, wherein a longitudinal axis of the air/oil separator around which introduced oil rotates is substantially parallel to the rotatable crankshaft.

3. Internal combustion engine as claimed in claim 1, wherein a tapering channel extends from each oil scraping opening to the at least one air/oil separator.

4. Internal combustion engine as claimed in claim 3, wherein each tapering channel empties tangentially into the at least one air/oil separator.

5. Internal combustion engine as claimed in claim 1, wherein the at least one air/oil separator comprises an air/oil separator associated with each of the oil scrapers.

6. Internal combustion engine as claimed in claim 1, wherein the at least one air/oil separator comprises a common air/oil separator associated with a plurality of the oil scrapers.

7. Internal combustion engine as claimed in claim 1, wherein the at least one air/oil separator has a substantially cylindrical housing on whose end facing the oil inlet opening has a central air exhaust line and on whose other end the oil outlet opening is laterally arranged.

8. Internal combustion engine as claimed in claim 1, wherein crank webs of the crankshaft are associated with additional oil scrapers.

9. Internal combustion engine as claimed in claim 1, wherein cover elements are provided between the between the crankshaft and the oil pan to prevent the oil from flowing back from the oil pan into the crankcase.

* * * * *